US005194356A

United States Patent [19]

Sacripante et al.

[11] Patent Number: 5,194,356

[45] Date of Patent: Mar. 16, 1993

[54] TONER COMPOSITIONS

[75] Inventors: Guerino Sacripante, Cambridge; Beng S. Ong, Mississauga, both of Canada; Michael J. Levy, Webster; Richard B. Lewis, Williamson, both of N.Y.

[73] Assignee: Xerox Corporation, Stamford, Conn.

[21] Appl. No.: 609,316

[22] Filed: Nov. 5, 1990

[51] Int. Cl.[5] ..... G03G 9/083

[52] U.S. Cl. ..... 430/106.6; 430/106; 430/109; 430/110; 430/111

[58] Field of Search ..... 430/106, 106.6, 107, 430/903, 137, 109, 45, 110, 111

[56] References Cited

U.S. PATENT DOCUMENTS

| | | | |
|---|---|---|---|
| 2,986,521 | 5/1961 | Weilicki | 252/62.1 |
| 4,051,077 | 9/1977 | Fisher | 252/62.1 P |
| 4,108,653 | 8/1978 | Peters | 96/15 D |
| 4,301,228 | 11/1981 | Kori et al. | 430/122 |
| 4,338,390 | 7/1982 | Lu | 430/106 |
| 4,560,635 | 12/1985 | Hoffend et al. | 430/106.6 |
| 4,626,487 | 12/1986 | Mitsuhashi et al. | 430/109 |
| 4,734,350 | 3/1988 | Lin et al. | 430/110 |
| 4,758,493 | 7/1988 | Young et al. | 430/122 |
| 4,803,144 | 2/1989 | Hosoi | 430/106.6 |
| 4,820,604 | 4/1989 | Manca et al. | 430/110 |
| 4,883,736 | 11/1989 | Hoffend et al. | 430/110 |
| 4,902,570 | 2/1990 | Heinemann | 428/405 |
| 4,904,762 | 2/1990 | Chang et al. | 430/110 |
| 4,937,167 | 6/1990 | Moffat et al. | 430/137 |
| 4,943,507 | 7/1990 | Takehashi et al. | 430/120 |
| 5,021,314 | 6/1991 | Vercoulen et al. | 430/106 |

FOREIGN PATENT DOCUMENTS

| | | |
|---|---|---|
| 59-200250 | 11/1984 | Japan . |
| 02163756 | 6/1990 | Japan . |

*Primary Examiner*—Marion E. McCamish
*Assistant Examiner*—Rosemary Ashton
*Attorney, Agent, or Firm*—E. O. Palazzo

[57] ABSTRACT

A colored magnetic toner composition comprised of a polymer resin or resins, an optional waxy, lubricating or low surface energy substance, a colorless or light colored magnetic material, a color pigment, dye or mixture thereof, excluding black, and a whitening agent; and wherein the surface of the toner contains a conductive metal oxide.

51 Claims, No Drawings

TONER COMPOSITIONS

BACKGROUND OF THE INVENTION

The present invention is generally directed to toner compositions, and more specifically to colored magnetic toner compositions. In one embodiment, the present invention is related to colored, magnetic toner compositions that can, for example, be selected for single component development, and more specifically for a number of known inductive single component development processes. In an embodiment, the present invention relates to toner compositions comprised of a polymer resin or resins, an optional waxy, lubricating or low surface energy substance, a colorless or light colored magnetic material, especially a grayish magnetite, a whitening agent, a color pigment, dye or mixture thereof, and a conductive component comprised of metal oxide, such as, for example, powdered tin oxide or titanium oxide, or a mixture of metal oxides. In one specific embodiment of the present invention, there are provided colored, magnetic toner compositions comprised of a known toner polymer, a waxy, lubricating or low surface energy component, a substantially colorless magnetic material, a whitening agent, a color pigment, and wherein the toner particles are coated with a conductive powdered additive comprised of a conductive metal oxide powder of, for example, tin oxide doped with bismuth. The conductive metal oxide powder may be embedded in the toner's surface to prevent its release therefrom. The aforementioned toner compositions generally can possess a volume resistivity of from about $10^3$ to about $10^8$ ohm-cm, and preferably a volume resistivity of about $10^4$ to about $10^6$ ohm-cm. This level of toner conductivity is particularly suited for use in a number of inductive single component development systems. In another specific embodiment of the present invention, there is provided a colored, magnetic toner composition comprised of an acrylic, methacrylic, styryl, polyesters, olefinic polymer resin, or the copolymeric derivatives thereof, such as poly(butyl methacrylates), styrene-butyl methacrylate copolymers, polypropylenes, polybutylenes, and the like; and dispersed in the toner polymer a waxy or lubricating material, such as hydrocarbon wax, silicones, fluorinated hydrocarbons, and the like, a substantially colorless or slightly grayish colored magnetic material, a whitener, and colored, other than black, pigment particles; and wherein the toner particles are coated with a conductive powder comprised of certain metal oxides, or mixtures thereof. A further embodiment of the present invention relates to the preparation of conductive powdered metal oxides or mixed oxides, and their application as toner conductivity control and surface release agents.

The metal oxide powders that can be selected preferably possess a primary particle size, or average particle diameter of less than 1,000 Angstroms, and more preferably an average particle diameter of from about 10 to about 1,000 Angstroms. These powders can be optionally treated, preferably surface treated with certain organosilane reagents primarily to improve their powder flow properties. Specifically, the conductive powders can possess a specific resistivity of less than 1,000 ohm-cm, and preferably less than 100 ohm-cm, such that when utilized as toner surface additives in an effective amount of, for example, generally less than 20 weight percent, can impart to the toner a volume resistivity of from about $10^3$ to about $10^8$ ohm-cm, and preferably from about $10^4$ to about $10^6$ ohm-cm. Examples of advantages associated with the colored, magnetic toner compositions of the present invention in embodiments thereof include brilliant image color and wide color variety; relatively high surface conductivity and thus suitability for use in a number of known inductive single component development systems; excellent image fix; nonagglomerating and excellent shelf like stability of, for example, up to 1 year in some instances; and suitability for use in highlight color reprographic processes, especially xerographic and ionographic imaging and printing processes. Additionally, the use of the aforementioned conductive powders can also enhance the toner powder flow characteristics, thus eliminating if desired the utilization of other additives such as Aerosils, and zinc stearate for surface release and flow properties. Another advantage of the conductive oxide powder is related to its ability to reduce the toner's sensitivity to humidity.

The toner compositions of the present invention can be selected for a variety of known reprographic imaging processes including electrophotographic, especially xerographic, and ionographic processes. In one embodiment, the toner compositions can be selected for pressure fixing processes wherein the image is fixed with pressure. Pressure fixing is common in ionographic processes in which latent images are generated on a dielectric receiver such as silicon carbide, reference U.S. Pat. No. 4,885,220, entitled Amorphous Silicon Carbide Electroreceptors, the disclosure of which is totally incorporated herein by reference. The latent images can then be toned with the relatively conductive toner of the present invention by inductive single component development, and transferred and fixed simultaneously (transfix) in one single step onto paper with pressure. Specifically, the toner compositions of the present invention can be selected for the commercial Delphax printers, such as the Delphax S9000 TM, S6000 TM, S4500 TM, S3000 TM, and Xerox Corporation printers such as the 4060 TM and 4075 TM wherein, for example, transfixing is utilized. In another embodiment, the toner compositions of the present invention can be utilized in xerographic imaging apparatuses wherein image toning and transfer are accomplished electrostatically, and transferred images are fixed in a separate step by means of a pressure roll with or without the assistance of thermal or photochemical energy fusing.

Heat and cold pressure fixable toner compositions are known. Cold pressure fixable toners have a number of advantages in comparison to toners that are fused by heat, primarily relating to the utilization of less energy since, for example, these toner compositions can be fused at room temperature. Cold pressure fixability also enables the machine's instant-on feature and permits the design of compact size high speed printers for space saving considerations. Nevertheless, many of the prior art cold pressure fixable toner compositions suffer from a number of deficiencies. For example, the prior art colored toners, particularly colored magnetic toners, usually do not possess sufficiently low volume resistivity of, for example, $10^4$ to $10^6$ ohm-cm to be useful for inductive single component development; the prior art colored magnetic toners also do not usually offer the desirable color quality or a wide color variety; and they in many instances have poor resistance against image smearing, and poor powder flow characteristics. Also, a number of the prior art magnetic toners, inclusive of black toners, often suffer from the known image ghosting problem when used in the transfix ionographic printers such as the Delphax printers. Additionally, the prior art colored magnetic toners are predominantly insulative in nature or possess very low surface conductivity characteristics of, for example, a volume resistivity in excess of $10^8$ ohm-cm; and these low levels of conductivity are not considered effectively suitable for inductive single component development, in particular those development systems that are utilized in the commercial Delphax or Xerox ionographic printers and copiers. Other disadvantages of many of the prior art magnetic toners inclusive of black toners generally have a large amount of loosely held surface additives which tend to separate and release from toner particles causing dirt buildup in the development housing as well as white streaks appearing on prints or copies. These and other disadvantages are eliminated, substantially eliminated, or minimized with the toners of the present invention. More specifically, with the colored magnetic toners of the present invention in embodiments thereof control of the toner surface conductivity, surface additive loading, and toners with excellent color quality can be achieved. Also, with the toners of the present invention, image ghosting can be eliminated, in many instances, primarily because of the utilization of the silane-treated conductive metal oxide powder in some embodiments. Image ghosting, which is one of the common known phenomena in transfix ionographic printing processes, refers to, for example, the contamination of the dielectric receiver by residual toner materials which cannot be readily removed in the cleaning process. The result is the retention of latent images on the dielectric receiver surface after cleaning, and the subsequent unwarranted development of these images. One of the usual causes of image ghosting is related to the use of unsuitable or inferior toner materials leading to their adherence to the dielectric receiver during the image development process.

The following United States patents are mentioned in a patentability search report for patent application U.S. Ser. No. 609,333 (U.S. Pat. No. 5,135,832), the disclosure of which is totally incorporated herein by reference, relating to encapsulated toners, and entitled Colored Toner Compositions; U.S. Pat. No. 4,803,144, which discloses an encapsulated toner with a core containing as a magnetizable substance a magnetite, see Example 1, which is black in color, wherein on the outer surface of the shell there is provided a white electroconductive powder, preferably a metal oxide powder, such as zinc oxide, titanium oxide, tin oxide, silicon oxide, barium oxide and others, see column 3, line 59 to column 4; in column 8 it is indicated that the colorant can be carbon black, blue, yellow, and red; in column 14 it is indicated that the electroconductive toner was employed in a one component developing process with magnetic brush development, thus it is believed that the toner of this patent is substantially insulating; U.S. Pat. No. 4,937,167 which relates to controlling the electrical characteristics of encapsulated toners, see for example columns 7 and 8 wherein there is mentioned that the outer surface of the shell may contain optional surface additives 7, examples of which include fumed silicas, or fumed metal oxides onto the surfaces of which have been deposited charge additives, see column 17 for example; U.S. Pat. No. 4,734,350 which discloses an improved positively charged toner with modified charge additives comprised of flow aid compositions having chemically bonded thereto, or chemically absorbed on the surface certain amino alcohol derivatives, see the Abstract for example; the disclosures of each of the aforementioned patents being totally incorporated herein by reference; and which according to the search report are not significant but may be of some background interest U.S. Pat. Nos. 2,986,521; 4,051,077; 4,108,653; 4,301,228; 4,301,228 and 4,626,487.

In a patentability search report in U.S. Pat. No. 5,104,763 (D/90066), relating to encapsulated toners, the disclosure of which is totally incorporated herein by reference, the following United States Patents were listed: U.S. Pat. No. 4,514,484 directed to a powder suitable for developing latent images comprised of magnetic particles coated with a mixture of a thermoplastic resin and a silane, see for example the Abstract of the Disclosure; note column 3, beginning at line 15, wherein it is indicated that into the organic thermoplastic resin is incorporated a silane selected from those illustrated; also incorporated into the thermoplastic resin are magnetic materials, see column 3, beginning at line 35; U.S. Pat. No. 4,565,773 directed to dry toners surface coated with nonionic siloxane polyoxy alkylene copolymers with a polar end, see the Abstract of the Disclosure; and primarily of background interest U.S. Pat. Nos. 4,640,881; 4,740,443; 4,803,144 and 4,097,404, the disclosures of which are totally incorporated herein by reference.

Toner compositions free of encapsulation are known, which toners can be comprised of polymer particles, pigment particles, including colored pigments, low molecular weight waxes, charge enhancing additives, and other additive components, reference for example U.S. Pat. Nos. 3,590,000; 3,983,045; 4,035,310; 4,298,672; 4,338,390; 4,560,635; 4,952,477; 4,939,061; 4,937,157; 4,904,762 and 4,883,736, the disclosures of each of these patents being totally incorporated herein by reference.

There is a need for colored toner compositions, and in particular colored magnetic toner compositions with many of the advantages illustrated herein. Also, there is a need for pressure fixable colored magnetic toners which can be utilized in transfix development systems. Moreover, there is a need for colored magnetic toners, wherein image ghosting, and the like can be avoided or minimized. Furthermore, there is a need for nonagglomerating colored magnetic toners which possess a long shelf life exceeding, for example, 12 months. Also, there is a need for colored magnetic toners with surface conductivity characteristics having a volume resistivity of, for example, from about $10^3$ ohm-cm to about $10^8$ ohm-cm, and preferably from about $10^4$ ohm-cm to about $10^6$ ohm-cm, thus enabling their use in a number of known xerographic, and inductive single component development systems. Furthermore, there is a need for colored magnetic toners with excellent powder flow and surface release properties enabling their selection for use in imaging systems without the use of surface release fluids such as silicone oils to prevent image offsetting to the fixing or fuser roll. Another need resides in the provision of colored magnetic toners that are substantially insensitive to changes in humidity. There is also a need for conductive surface additives which are capable of imparting desirable levels of surface conductivity to colored toners without adversely affecting their image color quality. Another associated need resides in the provision of preparative processes for obtaining conductive powdered metal oxides and mixed oxides, such as, for example, tin oxides, which possess a primary particle diameter of less than about 1,000 Angstroms, and a specific resistivity of less than about 1,000 ohm-cm, and which powders are useful as surface conductivity control and release agents for colored magnetic toner compositions free of encapsulation, which toners are suitable for xerographic development processes.

SUMMARY OF THE INVENTION

It is therefore a feature of the present invention to provide colored toner compositions with many of the advantages illustrated herein.

In another feature of the present invention there are provided colored magnetic toner compositions comprised of a polymer resin or resins, an optional waxy, lubricating or low surface energy substance, a color pigment or dye, a colorless or lightly colored magnetic material, and a whitener, and wherein the toner particles are coated with certain conductive metal oxide powders.

Another feature of the present invention is the provision of colored magnetic toners which provide brilliant colored images, which toners can be transfixed, that is, for example, pressure fixed followed by heat fusion.

A further feature of the present invention is the provision of colored magnetic toners wherein toner agglomeration is eliminated or minimized in some embodiments.

A still further feature of the present invention is to provide colored magnetic toners with excellent powder flow and release properties.

Moreover, another feature of the present invention is the provision of colored magnetic toners wherein image offsetting is eliminated in some embodiments, or minimized in other embodiments.

In still another feature of the present invention there are provided colored magnetic toners with extended shelf life.

A further feature of the present invention relates to colored magnetic toners which are suitable for xerographic, or inductive single component development systems.

Another feature of the present invention is directed to pressure fixable colored magnetic toners for transfix development applications.

An additional feature of the present invention is related to colored magnetic toners which are insensitive to changes in humidity.

Another feature of the present invention resides in the provision of colored conductive toners which contain very fine metal oxide powders with an average diameter of less than about 1,000 Angstroms, and more specifically from about 10 to about 1,000 Angstroms.

Still another feature of the present invention resides in the provision of colored conductive toners with a volume resistivity of from about $10^3$ to about $10^8$, and preferably from about $10^4$ to about $10^6$ ohm-cm, which toners enable developed images with brilliant colors.

Additionally, in another feature of the present invention there are provided colored magnetic toner compositions suitable for electrostatic imaging and printing apparatuses.

These and other features of the present invention can be accomplished by providing colored toner compositions, and more specifically colored magnetic toner compositions comprised of a polymer resin or a plurality of resins, an optional waxy, lubricating or low surface energy substance, a colorant, a substantially colorless or lightly colored magnetic material, and a whitener, and wherein the toner particles are coated with a conductive metal oxide powder. The toners of the present invention can be prepared by conventional known melt blending and mechanical micronization techniques which involve (1) mixing and melt blending a mixture of a polymer resin or resins, an optional waxy, lubricating or low surface energy substance, a colorant, a colorless or substantially colorless magnetic material, and a whitener; (2) extruding the melt blended mixture and micronizing the extruded mixture into fine particles; (3) isolating the resulting toner particles of a specific particle size by conventional classification technique; and (4) dry blending the classified particles with a conductive metal oxide powder. Surface release and flow additives may also be applied to the toner particles during dry blending. The surface conductivity characteristics of the toners are primarily achieved by the powder coating thereof with conductive powdered metal oxides or mixed oxides using known conventional dry blending and mixing techniques. Specifically, the volume resistivity of the toner can be desirably adjusted to, for example, from about $10^3$ to about $10^8$ ohm-cm, and preferably from about $10^4$ to about $10^6$ ohm-cm with the metal oxide, or mixtures thereof. Effective amounts of metal oxide powder of, for example, from about 1 to about 15 weight percent can be utilized, and which metal oxide powder has a low specific resistivity of generally less than 1,000 ohm-cm, and more specifically less than 100 ohm-cm. Furthermore, the metal oxide powder can possess a primary particle diameter of less than about 1,000 Angstroms, and more specifically less than about 150 Angstroms. Toners with conductive additives such as carbon black, graphite, and mixtures thereof are usually not considered suitable for magnetic colored toner compositions as they usually render the toners black in color. The aforementioned metal oxide surface additives of the present invention may also serve to impart the required powder flow and surface release properties to the resultant toners, thus eliminating the need for surface release and flow agents in some embodiments of the present invention.

The colored magnetic toners of the present invention generally have an average particle diameter of from about 5 to about 50 microns, a saturation magnetic moment of from about 25 to about 60 emu per gram, and a volume resistivity of from about $10^3$ to about $10^8$ ohm-cm, and preferably from about $10^4$ to $10^6$ ohm-cm, with the latter range of volume resistivity being particularly ideal for a number of commercial inductive single component development systems such as the Delphax printers S3000 TM, S4500 TM, and S6000 TM and the Xerox Corporation 4075 TM printer.

The aforementioned known conductive metal oxide powders are commercially available, or can be prepared by (1) high temperature flame hydrolysis of volatile metal compounds, such as titanium tetrahalide, especially the chloride, or tin tetrahalide, especially the chloride, in a hydrogen-oxygen flame, optionally in the presence of another metal dopant such as bismuth halide, especially the chloride in effective amounts of from about 0.1 to about 50 weight percent, and more specifically from about 5 to 15 weight percent, to yield a highly dispersed metal oxide or mixed oxide powder; and (2) subsequently heating the resultant metal oxide powder at a temperature of, for example, from about 400° C. up to 600° C. under a hydrogen atmosphere to remove the residual halides. Illustrative examples of powdered metal oxides suitable for the toners of the present invention include oxides or mixed oxides of aluminum, antimony, barium, bismuth, cadmium, chromium, germanium, indium, lithium, magnesium, molybdenum, nickel, niobium, ruthenium, silicon, tantalum, titanium, tin, vanadium, zinc, zirconium, and the like. The conductive metal oxide powders can be surface treated by the addition with mixing of certain silane agents to primarily improve their powder flow properties and to reduce their sensitivity to moisture.

Embodiments of the present invention include a colored magnetic toner composition comprised of a polymer resin or resins, a waxy, lubricating or low surface energy substance, a colorless or light colored magnetic material, a color pigment, dye or mixture thereof, excluding black, a whitening agent, a conductive metal oxide powder, and optional surface release and flow agents; a colored conductive magnetic toner composition comprised of a polymer resin or resins, a waxy, lubricating or low surface energy substance, a substantially colorless magnetic material, a color pigment, excluding black, and a whitening agent; and which toner particles are coated with a conductive metal oxide powder and optional surface release and flow agents, and wherein the toner has a volume resistivity of from about $10^3$ ohm-cm to about $10^8$ ohm-cm; a colored magnetic toner composition comprised of particles of a polymer resin, and dispersed therein a grayish color magnetic material, a pigment, and a whitening agent, and which toner is coated with conductive colorless, or substantially colorless aerosils of a conductive metal oxide powder and optional surface release and flow agents to provide the toner with a volume resistivity of from about $10^4$ ohm-cm to about $10^6$ ohm-cm, and which metal oxide can be comprised of the oxides of aluminum, antimony, barium, bismuth, cadmium, chromium, germanium, indium, lithium, magnesium, molybdenum, nickel, niobium, ruthenium, silicon, tantalum, titanium, tin, vanadium, zinc, zirconium, mixtures thereof, and the like.

Examples of known polymer resins present in effective amounts, for example of from about 20 to about 75 weight percent, that can be selected include, but are not limited to, acrylates, methacrylates, styrene polymers, styrene acrylates, styrene methacrylates, styrene butadienes, crosslinked polymers, wherein the crosslinking agent is, for example, divinylbenzene, polyesters, Elvax TM, available from E.I. DuPont, and the like. Illustrative examples of toner polymers include methyl acrylate, methyl methacrylate, ethyl acrylate, ethyl methacrylate, propyl acrylates, propyl methacrylates, butyl acrylates, butyl methacrylates, methyl acrylate-butyl acrylate copolymers, methyl methacrylate-butyl methacrylate copolymers propyl methacrylate-ethoxylpropyl methacrylate copolymers, styrene-alkyl acrylate copolymers, styrene-alkyl methacrylate copolymers, styrene-olefin copolymers, bisphenol A polyesters, terephthalic acid-based polyesters, isophthalic acid-based polyesters, polyethylenes, polypropylenes, polybutylenes, and the like. Specific examples of typical known toner polymers include styrene butyl methacrylate, especially styrene n-butyl methacrylate (58/42), styrene butadienes, such as Pliolites® and Plitones® available, for example, from Goodyear Chemical, and the like, reference the United States patents mentioned herein. Toner polymer examples are illustrated, for example, in U.S. Pat. Nos. 4,558,108; 4,469,770; 4,460,672; 4,560,635 and 4,952,477, the disclosures of which are totally incorporated herein by reference.

Various known waxy, lubricating or low surface energy substance, generally present in effective amounts of, for example, from 0 to about 55 weight percent of the toner, can be selected. Illustrative examples are natural waxes or lubricants including plant waxes such as candelilla wax, ouricury wax, or Japan wax; mineral waxes such as peat wax, montan wax, petroleum waxes or ozocerite; and synthetic waxes or lubricants including synthetic and modified ester waxes such as Hoechst waxes, chlorinated paraffins, esters of long-chain fatty acids and alcohols; silicones such as polydimethylsiloxanes; polyglycols such as polyethylene glycols, polypropylene glycols; polyethers such as polyoxyethylenes; polyolefins such as polyethylenes, polypropylenes, and the like, and mixtures thereof, reference U.S. Pat. No. 4,904,762 and British Patent 1,442,835, the disclosures of which are totally incoporated herein by reference.

Illustrative examples of known colorants or pigments present in an effective amount of, for example, from about 1 to about 20 percent by weight of toner, and preferably in an amount of from about 3 to about 10 weight percent that can be selected include Heliogen Blue L6900, D6840, D7080, D7020, Pylam Oil Blue and Pylam Oil Yellow, Pigment Blue 1 available from Paul Uhlich & Company Inc., Pigment Violet 1, Pigment Red 48, Lemon Chrome Yellow DCC 1026, E.D. Toluidine Red and Bon Red C available from Dominion Color Corporation Ltd., Toronto, Ontario, NOVAperm Yellow FGL, Hostaperm Pink E from Hoechst, Cinquasia Magenta available from E.I. DuPont de Nemours & Company, Lithol Scarlet, Hostaperm Blue, Hostaperm Red, Hostaperm Green, PV Fast Green, Cinquasia yellow, PV Fast Blue, and the like. Generally, colored pigments that can be selected are red, blue, green, brown, cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL.

Examples of colorless, substantially colorless or light color magnetic materials, which can be selected for the toner compositions of the present invention, and which are present in an effective amount of from, for example, about 20 to about 60 weight percent, include iron powder, such as those derived from the reduction of iron tetracarbonyl, and commercially available from BASF as Sicopur 4068 FF TM; cobalt powder, commercially available from Noah Chemical Company; Metglas TM and Metglas TM ultrafine, commercially available from Allied Company; treated iron oxides such as Bayferrox AC5106M TM, commercially available from Mobay; treated iron oxide TMB-50 TM, commercially available from Magnox; carbonyl iron Sf TM, commercially available from GAF Company; Mapico Tan TM, commercially available from Columbia Company; treated iron oxide MO-2230 TM, commercially available from Pfizer Company; nickel powder ONF 2460 TM, commercially available from Sherritt Gordon Canada Company; nickel powder; chromium powder; manganese ferrites; and the like. The preferred average diameter particle size of the magnetic material is from about 0.1 micron to about 6 microns, although other particle sizes may also be utilized.

Examples of conductive powders include powdered metal oxides such as tin oxide, zinc oxide, yttrium oxide, vanadium oxide, tungsten oxide, titanium oxide, thalium oxide, tantalum oxide, silicon oxide, ruthenium oxide, rhodium oxide, platinum oxide, palladium oxide, niobium oxide, nickel oxide, molybdenum oxide, manganese oxide, magnesium oxide, lithium oxide, iridium oxide, cobalt oxide, chromium oxide, cesium oxide, calcium oxide, cadmium oxide, bismuth oxide, berylium oxide, barium oxide, antimony oxide, aluminum oxide, mixtures thereof, and the like. The conductive powders are present in various effective amounts, such as, for example, from 0.1 to about to about 20 weight percent and preferably from about 1 to about 15 weight percent. In one specific embodiment of the present invention, the conductive powdered metal oxide is a mixed oxide comprising from about 90 to about 95 weight percent of tin oxide and from about 5 to about 10 weight percent of bismuth oxide or antimony oxide. The conductive powdered oxides assist in enabling the formation of a relatively conductive colored magnetic toner wherein high quality images can be obtained. Additionally, the aforementioned conductive metal oxide powders can be surface treated with a known silane agent, such as, for example, hexamethyl disilazane or bis(trimethylsilyl-)acetamide, and the like by exposing the oxide powders to silane vapour at elevated temperature of, for example, 200° C. to 300° C. to improve their powder flow characteristics. The effective amount of silane agent is, for example, from about 0.1 to about 10 weight percent, and preferably from about 0.5 to about 5 weight percent. Mixtures of metal oxides include two or more metal oxides present in effective amounts, for example the mixture can contain from about 40 to about 95 weight percent of a first metal oxide and about 60 to about 5 weight percent of a second metal oxide.

Various suitable known whitening agents can be selected, such as an inorganic white powder selected from the group consisting of powdered aluminum oxide, barium oxide, calcium carbonate, calcium oxide, magnesium oxide, magnesium stearate, titanium oxide, tin oxide, zinc oxide, zinc stearate, and the like. The whitening agent can be present in the toner in various effective amounts, for example from about 1 to about 20 weight percent.

In embodiments of the present invention there can be added to the toner product surface by mixing, for example, additional known surface and flow aid additives such as Aerosils, such as Aerosil R972 TM, metal salts, metal salts of fatty acids, such as zinc stearate, and the like, in effective amounts of, for example, from about 0.1 to about 3, and preferably about 1 weight percent, reference for example the United States patents mentioned herein. Examples of the aforementioned additives are illustrated in U.S. Pat. Nos. 3,590,000; 3,720,617; 3,900,588 and 3,983,045, the disclosures of which are totally incorporated herein by reference.

The toners of the present invention can be prepared by a number of known methods, reference a number of the United States patents mentioned herein, including, for example, melt mixing the components in a Banbury Mill, followed by attrition and classification enabling, for example, toner particles with an average particle diameter of from about 10 to about 25 microns. Subsequently, the additives, such as the metal oxide powders, flow aids, release components and the like, can be added to the toner formed by mixing therewith. Also, known extrusion processes can be utilized for the preparation of the toner composition.

Carriers that may be selected for the formation of two component developers are well known, and include, for example, iron, steel, ferrites, such as zinc copper ferrites, and the like. The carrier cores may include coatings thereover, such as polymers like fluorocarbons, such as polyvinylidene fluoride, Kynar ®, methyl terpolymers, and the like, reference for example U.S. Pat. Nos. 3,526,533; 3,467,634; 3,839,029; 3,849,182; 3,914,181; 3,929,657; 4,042,518; 4,937,166; 4,935,326, the disclosures of which are totally incorporated herein by reference, and the like. The toner concentration in the developer is, for example, from about 1 to about 10, and preferably from about 2 to about 5 weight percent in embodiments of the present invention.

The disclosures of each of the United States patents mentioned herein are totally incorporated herein by reference.

The following examples are being submitted to further define various aspects of the present invention. These examples are intended to be illustrative only and are not intended to limit the scope of the present invention.

EXAMPLE I

The following Example illustrates the preparation of a conductive tin oxide powder that was utilized to assist in rendering the toner composition of the present invention to a specific level of conductivity.

Nitrogen gas (2.0 liters per minute) was bubbled through tin tetrachloride (100 grams) at room temperature, about 25° C., and the resulting vapor was mixed with oxygen and hydrogen, both flowing at about 0.7 liter per minute, with the feed oxygen and hydrogen flow rates maintained at 0.85 liter per minute. The resulting mixture with approximate molar ratios of tin tetrachloride 1, nitrogen 59, hydrogen 15, and oxygen 15, was then burned into a flame. The combustion products were allowed to agglomerate in flight for about 10 seconds in a glass tube heated to about 200° C., and then collected in a Teflon fabric filter by suction. The collected tin oxide product (55.0 grams) was heated in a 500 milliliter rotating flask at 400° C. A stream of air and water vapor was passed into the flask for 30 minutes, followed by a stream of hydrogen gas, argon gas and water vapor for another 30 minutes. The gas flow rate was adjusted to provide more than 10 flask volume exchanges in each of these treatments. The resulting off-white tin (IV) oxide product (54.0 grams) had an average particle diameter size of about 90 Angstroms as measured by transmission electron microscopy, and a specific resistivity determined by known methods, and more specifically as indicated herein, see Example IV, of 18 ohm-cm was obtained on a pressed pellet sample.

EXAMPLE II

The following procedure illustrates the preparation of a conductive doped tin oxide powder:

Nitrogen gas (2.0 liters per minute) was bubbled through tin tetrachloride at room temperature, and was then passed over a bed of bismuth trichloride crystals maintained at a temperature of about 160° C. by electric heaters. The resulting vapor was mixed with oxygen and hydrogen, both flowing at about 0.7 liter per minute. The resulting gas mixture was maintained at 160° C. and burned in a flame. The molar ratios of the gas mixture were about the same as in Example I except for added traces of bismuth trichloride at about 0.3 percent molar versus tin tetrachloride. The combustion products were allowed to agglomerate in flight for about 10 seconds in a glass tube heated to about 200° C., and then collected in a Teflon fabric filter by suction. The collected doped tin oxide product (60.0 grams) was subsequently heated in a 500 milliliter rotating flask at 400° C. A stream of air and water vapor was passed into the flask for 30 minutes, followed by a stream of hydrogen gas, argon gas and water vapor for another 30 minutes. The gas flow rate was adjusted to give more than 10 flask volume exchanges in each of these treatments. The resulting off-white doped tin (IV) oxide powder (59.0 grams) had an average primary particle size of about 100 Angstroms as measured by transmission electron microscopy, and a specific resistivity of 11 ohm-cm was obtained on a pressed pellet sample.

EXAMPLE III

The following procedure illustrates the preparation of a conductive silane-treated tin oxide powder:

Tin (IV) oxide powder (50.0 grams) as prepared in Example I, was placed into a rotating 500 milliliter flask heated at 300° C. Hexamethyldisilazane vapor generated by passing a stream of argon into liquid hexamethyldisilazane (16.0 grams) in another flask was passed into the flask containing tin oxide powder. The resulting off-white silane-treated tin (IV) oxide powder had an average primary particle size of about 100 Angstroms as measured by transmission electron microscopy, and a specific resistivity of 210 ohm-cm was obtained on a pressed pellet sample.

EXAMPLE IV

The following is an illustrative Example for the preparation of a 19.1 micron red magnetic toner using a grayish iron powder magnetic material, Lithol Scarlet pigment, titanium oxide whitener and the conductive tin oxide powder of Example I as the surface conductivity, release and flow control agent.

A mixture of 108.0 grams of Polywax 2,000 TM (Petrolite), 24.0 grams of Elvax 420 (Dupont), 24.0 grams of Versamid 744 (Henkle), 168.0 grams of iron powder (Sicopur 4068, BASF), 28.0 grams of Lithol Scarlet pigment, and 48.0 grams of titanium dioxide (RH6DX, Tioxide) were mixed and ground in a Fitzmill Model J equipped with a 850 micrometer screen. After grinding, the mixture was dry blended first on a paint shaker and then on a roll mill. A small DAVO TM counter-rotating twin screw extruder was then used to melt mix the aforementioned mixture. A K-Tron twin screw volumetric feeder was employed in feeding the mixture to the extruder which had a barrel temperature of 150° C. (flat temperature profile), and a screw rotational speed of 60 rpm with a feed rate of 10 grams per minute. The extruded strands were broken down into coarse particles by passing them through a Model J Fitzmill twice, first with an 850 micrometer screen, and then with a 425 micrometer screen. The coarse particles thus produced were micronized using an 8 inch Sturtevent micronizer and classified in a Donaldson classifier. The classified particles were then dry blended with 5.5 percent by weight of the conductive tin oxide of Example I in a Lightnin CBM dry blender at 3,000 rpm for 20 minutes, followed by sieving through a 63 micron screen. The resulting red toner had a volume average particle diameter of 19.1 microns and a particle size distribution of 1.31 as determined by Coulter Counter measurements using Coulter Counter Model ZM, available from Coulter Electronics, Inc.

The volume resistivity of the toner was measured by gently filling a 1 $cm^3$ cell sitting on a horseshoe magnet with a sample of the above powdered toner. Two opposite walls of the cell were comprised of 1 centimeter × 1 centimeter conductive metal plates. The other two walls and the bottom of the cell were also 1 centimeter × 1 centimeter in dimension, and were comprised of an insulating polymeric material. A voltage of 10 volts was applied across the plates, and the current flowing through the plates was measured using an electrometer. The device was standardized using a nickel standard whose saturation magnetic moment was known (55 emu/gram). The nickel sample was magnetized between two magnetic pole faces with a saturating magnetic field of 2,000 Gauss, such that the induced magnetic field was perpendicular to one of the faces of the cell. The integrated current that was induced when the nickel sample was removed from the saturating magnetic field was measured. Next, the integrated current induced by a toner sample under identical conditions was also measured. The toner's saturation magnetic moment was then obtained by referencing its induced current per gram of sample to that of the nickel sample. For the toner of this Example, the volume resistivity was $8.8 \times 10^6$ ohm-cm and the saturation magnetic moment was 44.0 emu per gram.

The above prepared toner was evaluated in a Xerox Corporation 4060 TM printer. The toned images were transfixed onto paper with a transfix pressure of 4,000 psi. Print quality was evaluated from a checkerboard print pattern. The image optical density was measured with a standard integrating densitometer. Image fix was measured by the standardized scotch tape pull method, and was expressed as a percentage of the retained image optical density after the tape test relative to the original image optical density. Image smearing was evaluated qualitatively by hand rubbing the fused checkerboard print using a blank paper under an applied hand force, and viewing the surface cleanliness of unprinted and printed areas of the page. Image ghosting on paper was evaluated visually. For the above prepared toner, the image fix level was 71 percent, and no image smear and no image ghosting were observed in this machine testing for at least 2,000 prints.

EXAMPLE V

The following is an illustrative Example for the preparation of a 16.8 micron blue magnetic toner using a grayish iron powder magnetic material, Hostaperm Blue pigment, titanium oxide whitener and the conductive tin oxide powder of Example I as the surface conductivity, release and flow control agent.

The blue toner was prepared in accordance with the procedure of Example IV except that Hostaperm Blue pigment (Hoechst) was employed in place of Lithol Scarlet pigment. The blue toner product of this Example had a volume average particle diameter of 16.8 microns and a particle size distribution of 1.36. The toner's saturation magnetic moment was measured to be 49 emu per gram, and the toner volume resistivity was found to be $7.8\times10^6$ ohm-cm. The toner was evaluated according to the procedure of Example IV, and the image fix level was 69 percent, and no image ghosting and no image smear were observed.

EXAMPLE VI

The following is an illustrative Example for the preparation of a 17.5 micron blue magnetic toner using a grayish iron powder magnetic material, Hostaperm Blue pigment, titanium oxide whitener and the conductive tin oxide powder of Example II as the surface conductivity, release and flow control agent.

The toner was prepared in accordance with the procedure of Example IV with the exception that 4.2 percent by weight of the conductive doped tin oxide powder of Example II was utilized to control the conductivity, release and flow characteristics of the toner. The final toner had a volume average particle diameter of 17.5 microns and a particle size distribution of 1.33. The toner's saturation magnetic moment was measured to be about 45 emu per gram, and the toner volume resistivity was found to be $8.1\times10^5$ ohm-cm. For this toner, the image fix level was 67 percent, and no image smear and no image ghosting were observed after 2,000 prints. This toner did not show signs of agglomeration with storage for seven months.

EXAMPLE VII

An 18.8 micron green toner with Sicopur 4068 TM iron powder was prepared in accordance with the procedure of Example IV except that Hostaperm Green pigment (Hoechst) was utilized in place of Lithol Scarlet pigment. The particles obtained after particle size classification were dry blended with 5.5 percent by weight of the conductive, silane-treated tin oxide powder of Example III. The green toner obtained had a volume average diameter of 18.8 microns and a particle size distribution of 1.30. The toner's volume resistivity was $7.3\times10^6$ ohm-cm, and its saturation magnetic moment was measured to be 47 emu per gram. The toner was evaluated in accordance with the procedure of Example IV, and substantially similar results were obtained.

EXAMPLE VIII

A 19.9 brown toner with Magnox iron oxide TMB-50, Microlith Brown pigment, titanium dioxide and conductive silane-treated tin oxide of Example III was prepared in accordance with the procedure of Example IV except that Magnox iron oxide TMB-50 TM and 5.0 grams of Microlith Brown pigment were utilized instead of Sicopur 4068 TM iron powder and Lithol Scarlet pigment (BASF), respectively. The particles obtained after particle size classification were dry blended with 5.5 percent by weight of the conductive silane-treated tin oxide powder of Example III. The resulting toner had a volume average particle diameter of 19.9 microns and a particle size distribution of 1.29. The toner displayed a volume resistivity of $8.5\times10^6$ ohm-cm and a saturation magnetic moment of 44 emu per gram. The toner was evaluated in accordance with the procedure of Example IV, and substantially similar results were obtained.

Other modifications of the present invention may occur to those skilled in the art subsequent to a review of the present application, and these modifications are intended to be included within the scope of the present invention.

What is claimed is:

1. A colored magnetic toner composition consisting essentially of a polymer resin or resins, a waxy, lubricating or low surface energy substance, a colorless or lightly colored magnetic material, a color pigment, excluding black, and a whitening agent; and wherein the surface of the toner contains a conductive metal oxide which oxide has been surface treated with a silane component; and wherein said metal oxide has an average particle diameter of from between about 10 to about 1,000 Angstroms, and said metal oxide is selected from the group consisting of the oxides of aluminum, antimony, barium, bismuth, cadmium, chromium, germanium, indium, lithium, magnesium, molybdenum, nickel, niobium, ruthenium, silicon, tantalum, titanium, tin, vanadium, zinc, and zirconium; and which toner has a volume resistivity of from about $10^3$ to about $10^8$ ohm-cm.

2. A toner is accordance with claim 1 wherein the conductive metal oxide is comprised of tin with an average particle diameter size of about 90 Angstroms and a resistivity of 18 ohm-cm.

3. A toner in accordance with claim 1 wherein the conductive metal oxide is present in an amount of from about 0.1 weight percent to about 20 weight percent.

4. A toner in accordance with claim 1 where the volume resistivity of the toner is from about $10^4$ ohm-cm to about $10^6$ ohm-cm.

5. A toner in accordance with claim 1 containing surface release and flow additives.

6. A toner in accordance with claim 5 wherein the additive is present in an amount of from about 0.05 to about 5 weight percent.

7. A toner composition in accordance with claim 1 wherein the colorless or light colored magnetic material is selected from the group consisting of Sicopur 4068 FF TM, Metglas TM, Metglas TM ultrafine, treated iron oxides, carbonyl iron Sf TM, Mapico Tan TM, nickel powder, chromium powder, and manganese ferrites.

8. A toner composition in accordance with claim 1 wherein the whitening agent is an inorganic white powder selected from the group consisting of powdered aluminum oxide, barium oxide, calcium carbonate, calcium oxide, magnesium oxide, magnesium stearate, titanium oxide, tin oxide, zinc oxide, and zinc stearate.

9. A toner composition in accordance with claim 1 wherein the silane reagent is hexamethyl disilazane, bis(trimethylsilyl)acetamide, alkyltrialkoxysilane, dialkyldialkoxysilane, alkoxytrialkylsilane, or a siloxysilane.

10. A toner in accordance with claim 1 wherein the polymer resin or resins are present in an amount of from about 20 to about 75 weight percent of the toner; the waxy, lubricating or low surface energy substance is present in an amount of from about 0 to about 55 weight percent; the magnetic material is present in an amount of from about 20 to about 60 weight percent; the color pigment is present in an amount of from about 1 to about 20 weight percent; the whitening agent is present in an amount of from about 1 to about 20 weight percent; and the conductive metal oxide is present in an amount of from about 0.1 to about 20 weight percent of toner.

11. A toner in accordance with claim 1 containing charge enhancing additives.

12. A toner in accordance with claim 11 with surface additives.

13. A toner in accordance with claim 12 wherein the surface additives are comprised of metal salts of fatty acids, colloidal silica, or mixtures thereof.

14. A toner in accordance with claim 1 with a coating of a charge enhancing additive.

15. An imaging method which comprises the formation of an image on an imaging member; subsequently developing the image with the toner of claim 1; transferring the image to a suitable substrate and affixing the image thereto.

16. A conductive colored magnetic toner composition consisting essentially of a polymer resin, a waxy, lubricating or low surface energy substance, a substantially colorless magnetic material, a color pigment, excluding black, and a whitening agent; and wherein the surface of the toner is coated with a conductive metal oxide powder which has been surface treated with a silane component and wherein the metal oxide has an average particle diameter of from between about 10 to about 1,000 Angstroms, and is selected from the group consisting of the oxides of aluminum, antimony, barium, bismuth, cadmium, chromium, germanium, indium, lithium, magnesium, molybdenum, nickel, niobium, ruthenium, silicon, tantalum, titanium, tin, vanadium, zinc, and zirconium; and wherein said toner has a volume resistivity of from about $10^3$ to about $10^8$ ohm-cm.

17. A toner in accordance with claim 16 wherein the conductive metal oxide is a powder present in an amount of from about 0.1 weight percent to about 20 weight percent.

18. A toner in accordance with claim 16 where the volume resistivity of the toner is from about $10^4$ ohm-cm to about $10^6$ ohm-cm.

19. A toner in accordance with claim 16 containing flow aid additives, surface release additives, or mixtures thereof.

20. A toner in accordance with claim 19 wherein the additive is comprised of metal salts, metal salts of fatty acids, or colloidal silicas.

21. A toner in accordance with claim 20 wherein zinc stearate is selected.

22. A toner in accordance with claim 16 wherein the toner is comprised of from about 20 to about 75 weight percent of polymer resin or resins, from about 0 to about 55 weight percent of a waxy, lubricating or low surface energy substance, from about 1 to 20 weight percent of pigment, from about 20 to about 60 weight percent of a substantially colorless magnetic material, from about 1 to about 20 weight percent of a whitening agent, and from about 0.1 to about 20 weight percent of conductive metal oxide powder.

23. A toner composition in accordance with claim 16 wherein the color pigment is selected from the group consisting of red, blue, green, brown, cyan, magenta, yellow or mixtures thereof.

24. A toner composition in accordance with claim 16 wherein the waxy, lubricating or low surface energy material is selected from the group consisting of natural waxes and lubricants, animal waxes, plant waxes, mineral waxes, hydrocarbon waxes, polyglycols, polyethers, polyolefins, polyesters, and mixtures thereof.

25. A toner composition in accordance with claim 16 wherein the pigment is selected from the group consisting of Heliogen Blue L6900, D6840, D7080, D7020, Pylam Oil Blue and Pylam Oil Yellow, Pigment Blue 1, Pigment Violet 1, Pigment Red 48, Lemon Chrome Yellow DCC 1026, E. D. Toluidine Red and Bon Red C, NOVAperm Yellow FGL, Hostaperm Pink E, Cinquasia Magenta, Lithol Scarlet, Hostaperm Blue, Hostaperm Red, Hostaperm Green, PV Fast Green, Cinquasia Yellow, PV Fast Blue, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, copper tetra-(octadecylsulfonamido) phthalocyanine, x-copper phthalocyanine pigment listed in the Color Index as Cl 74160, Cl Pigment Blue, and Anthrathrene Blue identified in the Color Index as Cl 69810, Special Blue X-2137, diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL.

26. A toner composition in accordance with claim 16 wherein the substantially colorless magnetic material is selected from the group consisting of Sicopur 4068 FF TM, Metglas TM, Metglas TM ultrafine, treated iron oxides, carbonyl iron Sf TM, Mapico Tan TM, nickel powder, chromium powder, and manganese ferrites.

27. A toner composition in accordance with claim 16 wherein the whitening agent is an inorganic white powder selected from the group consisting of powdered aluminum oxide, barium oxide, calcium carbonate, calcium oxide, magnesium oxide, magnesium stearate, titanium oxide, tin oxide, zinc oxide, and zinc stearate.

28. A toner composition in accordance with claim 16 wherein the silane reagent is hexamethyl disilazane, bis(trimethylsilyl)acetamide, alkyltrialkoxysilane, dialkyldialkoxysilane, alkoxytrialkylsilane, or a siloxysilane.

29. A toner in accordance with claim 16 wherein the polymer resin or resins are present in an amount of from about 20 to about 75 weight percent of the toner; the waxy, lubricating or low surface energy substance is present in an amount of from about 0 to about 55 weight percent; the magnetic material is present in an amount of from about 20 to about 60 weight percent; the color pigment is present in an amount of from about 1 to about 20 weight percent; the whitening agent is present in an amount of from about 1 to about 20 weight percent; and the conductive metal oxide powder is present in an amount of from about 0.1 to about 20 weight percent of toner.

30. A toner in accordance with claim 16 wherein the color pigment is selected from the group consisting of Heliogen Blue, Pylam Oil Blue, Pylam Oil Yellow, Pigment Blue, Pigment Violet, Pigment Red, Lemon Chrome Yellow, Bon Red, NOVAperm Yellow FGL, Hostaperm Pink, 2,9-dimethyl-substituted quinacridone, Dispersed Red, Solvent Red, copper tetra(octadecyl sulfonamido) phthalocyanine, copper phthalocyanine, diarylide yellow 3,3-dichlorobenzidene acetoacetanilides, a nitrophenyl amine sulfonamide, Dispersed Yellow 2,5-dimethoxy-4-sulfonanilide phenylazo-4'-chloro-2,5-dimethoxy acetoacetanilide, and Permanent Yellow FGL.

31. A toner in accordance with claim 16 wherein the conductive metal oxide powder is comprised of from about 80 to about 95 weight percent of tin oxide and from about 5 to about 20 weight percent of bismuth.

32. A colored toner in accordance with claim 16 wherein the conductive metal oxide is comprised of from about 80 to about 95 weight percent of titanium oxide and from about 5 to about 20 weight percent of bismuth.

33. A toner in accordance with claim 16 wherein the conductive metal oxide is comprised of from about 80 to about 95 weight percent of tin oxide and from about 5 to about 20 weight percent of antimony.

34. A colored toner in accordance with claim 16 wherein the conductive metal oxide is comprised of from about 80 to about 95 weight percent of titanium oxide and from about 5 to about 20 weight percent of antimony.

35. A toner composition in accordance with claim 16 wherein the magnetic material is selected from the group consisting of iron powder, nickel powder, treated iron oxide powder, and mixtures thereof.

36. A toner composition in accordance with claim 16 wherein the whitening agent is powdered aluminum oxide, barium oxide, calcium carbonate, calcium oxide, magnesium oxide, magnesium stearate, titanium oxide, tin oxide, zinc oxide, or zinc stearate.

37. A toner in accordance with claim 16 containing charge enhancing additives.

38. An imaging method which comprises the formation of an image on an imaging member; subsequently developing the image with the toner of claim 16; transferring the image to a suitable substrate and affixing the image thereto.

39. A colored magnetic toner composition consisting essentially of a polymer resin, a grayish color magnetic material, a pigment, and a whitening agent; and wherein the surface of the toner is coated with a conductive metal oxide powder, which oxide has been surface treated with a silane component and has an average particle diameter of 10 to about 1,000 Angstroms, and wherein said metal oxide is selected from the group consisting of the oxides of aluminum, antimony, barium, bismuth, cadmium, chromium, germanium, indium, lithium, magnesium, molybdenum, nickel, niobium, ruthenium, silicon, tantalum, titanium, tin, vanadium, zinc, and zirconium; and which toner has a volume resistivity of from about $10^4$ to about $10^6$ ohm-cm.

40. A toner in accordance with claim 39 wherein the conductive metal oxide is comprised of mixed metal oxides wherein the metals are selected from the group consisting of aluminum, antimony, barium, bismuth, cadmium, chromium, germanium, indium, lithium, magnesium, molybdenum, nickel, niobium, ruthenium, silicon, tantalum, titanium, tin, vanadium, zinc, or zirconium; and wherein one of the metals is present in an amount of from about 0.01 to about 50 mole percent.

41. A toner composition in accordance with claim 39 wherein the magnetic material is selected from the group consisting of Sicopur 4068 FF TM, Metglas TM and Metglas TM ultrafine, treated iron oxides, carbonyl iron Sf TM, Mapico Tan TM, nickel powder, chromium powder, and manganese ferrites.

42. A toner composition in accordance with claim 39 wherein the conductive metal oxide powder is tin oxide, tin oxide doped with bismuth, tin oxide doped with antimony, titanium oxide, titanium oxide doped with tantalum, titanium oxide doped with antimony, or titanium oxide doped with indium.

43. A toner composition in accordance with claim 42 wherein the dopant in the conductive oxide powder is present in an amount of from about 0.1 to about 20 mole percent.

44. A toner composition in accordance with claim 39 wherein the polymer resin or resins are selected from the group consisting of acrylate polymers, methacrylate polymers, ethylene polymer, propylene polymers, butylene polymers, styrene polymers, and polyesters.

45. A toner composition in accordance with claim 39 wherein iron powder or nickel powder is selected as the magnetic material.

46. A toner composition in accordance with claim 39 wherein titanium oxide is selected as the whitening agent.

47. A toner in accordance with claim 39 wherein the pigment is a cyan pigment or dye, a magenta pigment or dye, a yellow pigment or dye, or mixtures thereof; blue, green, red, brown pigment or dye, or mixtures thereof.

48. A toner in accordance with claim 39 containing charge enhancing additives.

49. An imaging method which comprises the formation of an image on an imaging member; subsequently developing the image with the toner of claim 39; transferring the image to a suitable substrate and affixing the image thereto.

50. A toner in accordance with claim 39 wherein the resin is a styrene acrylate, a styrene methacrylate, or a styrene butadiene.

51. A color magnetic toner composition consisting essentially of a polymer resin particle, a waxy component, colored pigment particles, a substantially colorless, or lightly colored magnetic material, and a whitening agent; and wherein the toner particles are coated with colorless conductive components comprised of mixed oxides of tin and bismuth, mixed oxides of tin and antimony, mixed oxides of tin and tantalum, mixed oxides of tin and niobium, mixed oxides of titanium and bismuth, mixed oxides of titanium and antimony, mixed oxides of titanium and tantalum, and mixed oxides of titanium and niobium; and wherein said colorless conductive components have been surface treated with a silane component and said colorless conductive components have an average particle diameter of 10 to 1,000 Angstroms, and wherein said toner has a volume resistivity of from about $10^3$ to $10^8$ ohm-cm.

* * * * *